US007189168B2

(12) United States Patent
Lin

(10) Patent No.: US 7,189,168 B2
(45) Date of Patent: Mar. 13, 2007

(54) GOLF CLUB GRIP

(76) Inventor: Chin-Pai Lin, No.132, Nan Hsing Rd., Chung Jou Village, Hsin Yuan Hsiang, Pingtung Hsien (TW)

( * ) Notice: Subject to any disclaimer, the term of this patent is extended or adjusted under 35 U.S.C. 154(b) by 0 days.

(21) Appl. No.: 11/144,726

(22) Filed: Jun. 3, 2005

(65) Prior Publication Data

US 2006/0276262 A1 Dec. 7, 2006

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS 5,795,242 A * 8/1998 Ree ..... 473/303
6,718,675 B1 * 4/2004 Lu ..... 40/661.12
2002/0107088 A1 * 8/2002 Lamkin et al. ..... 473/300
2004/0185958 A1 * 9/2004 Huang ..... 473/300

* cited by examiner

*Primary Examiner*—Stephen Blau
(74) *Attorney, Agent, or Firm*—William E. Pelton, Esq.; Cooper & Dunham LLP

(57) ABSTRACT

A golf club grip has an inner sleeve and an outer sleeve. The inner sleeve has a first end, a second end, an outer wall and an elongated annular recess. The elongated annular recess is formed in the outer wall near the first end. The outer sleeve is mounted in the elongated annular recess and has a rough external wall. Mounting the outer sleeve in the elongated annular recess can provide enough shock absorbability to prevent hands and arms of players from being injured when hitting a golf ball. The rough external wall of the outer sleeve prevents the golf club from slipping.

3 Claims, 7 Drawing Sheets

GOLF CLUB GRIP

BACKGROUND OF THE INVENTION

1. Field of the Invention

The present invention relates to a grip, especially to a golf club grip.

2. Description of the Prior Arts

A golf club has a shaft, a head and a grip. The shaft has a lower end and an upper end. The head is attached to the lower end of the shaft to hit golf balls. The grip is attached to the upper end of the shaft for players to hold the golf club. With reference to FIGS. 5 and 6, a conventional grip (40) is made of rubber and comprises a single layer and a smooth outside surface. The conventional grip (40) is attached tightly to the upper end of the shaft so the shaft stretches the conventional grip to make the conventional grip (40) lose elasticity. Because the conventional grip (40) only has a single layer and is stretched by the shaft, the conventional grip (40) cannot absorb most shock when hitting a golf ball. Therefore hands and arms of players are easily injured when hitting a golf ball. Furthermore, the smooth outside surface of the conventional grip (40) easily slips out of a player's hands when hitting a golf ball.

To overcome the shortcomings, the present invention provides a grip on a golf club that has enough shock absorbability and prevents slipping to mitigate or obviate the aforementioned problems.

SUMMARY OF THE INVENTION

The main objective of the present invention is to provide an a golf club grip that has enough shock absorbability and prevents a golf club from slipping out of a player's hands. The golf club grip has an inner sleeve and an outer sleeve. The inner sleeve has a first end, a second end, an outer wall and an elongated annular recess. The elongated annular recess is formed in the outer wall near the closed end. The outer sleeve is mounted in the elongated annular recess and has a rough external wall. Mounting the outer sleeve in the elongated annular recess can provide enough shock absorbability to prevent hands and arms of players from being injured when hitting a golf ball. The rough external wall of the outer sleeve prevents the golf club from slipping.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
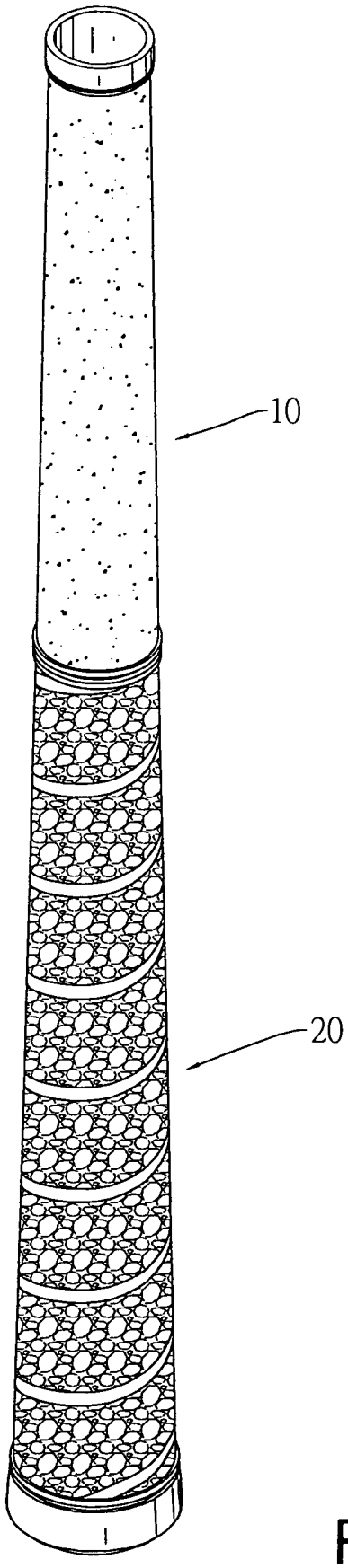
FIG. 1 is a perspective view of a golf club grip in accordance with the present invention.

With reference to FIG. 1, a golf club grip in accordance with the present invention is made of rubber and comprises an inner sleeve (10) and an outer sleeve (20).

Figure 2:
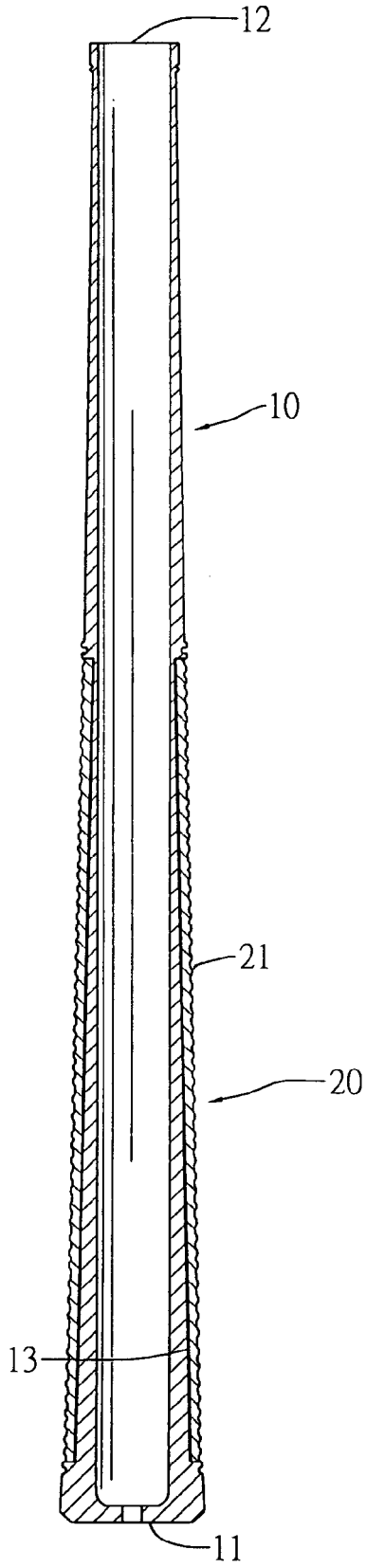
FIG. 2 is a cross sectional side view of the golf club grip in FIG. 1.

With further reference to FIG. 2, the inner sleeve (10) is tubular and has an elasticity, a hardness, an external wall, a first end (11), a second end (12) and an elongated annular recess (13). The elongated annular recess (13) is formed in the external wall of the inner sleeve (10) near the first end (11) and has two ends and a bottom surface.

Figure 3:
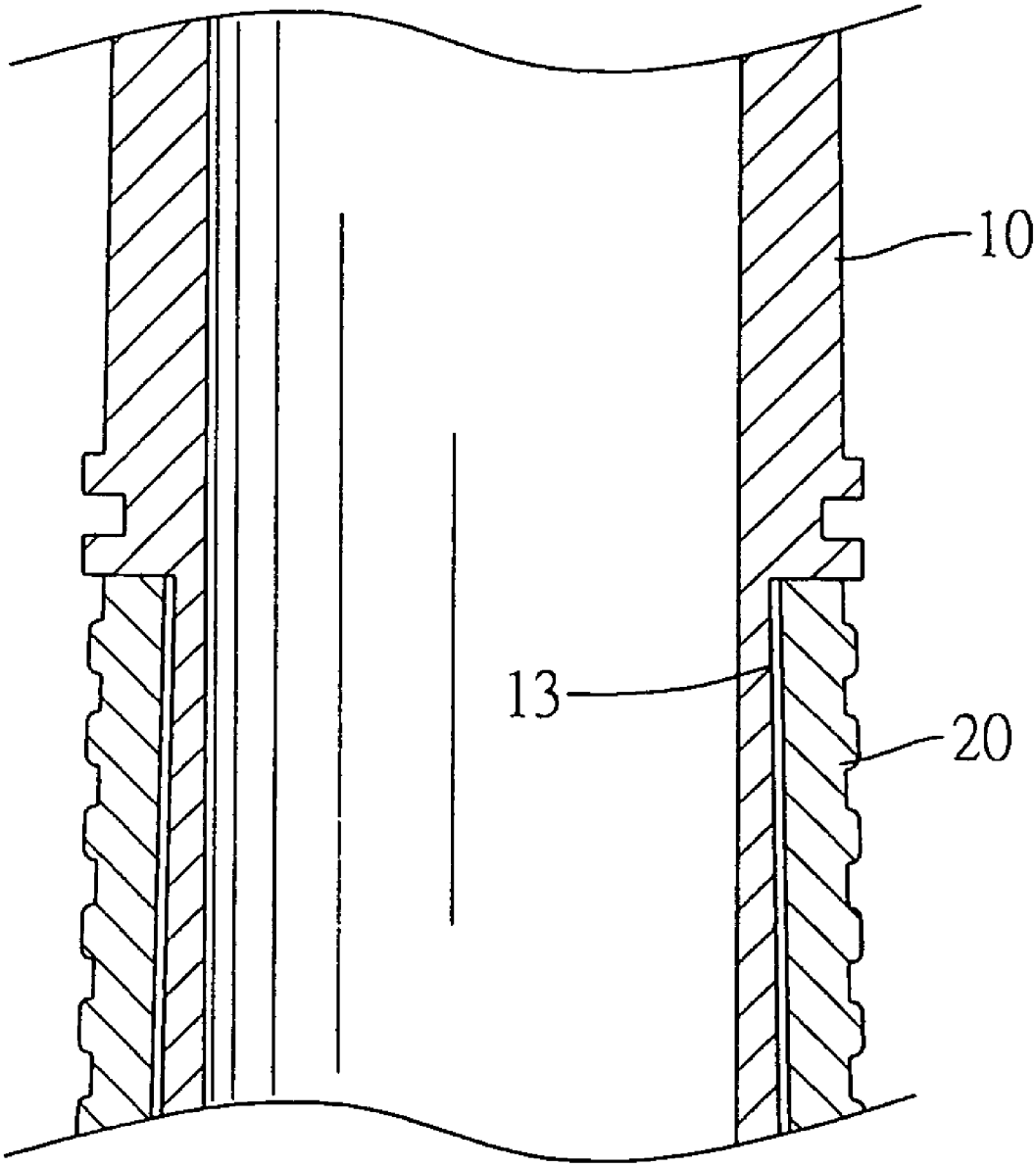
FIG. 3 is an enlarged cross sectional side view of the golf club grip in FIG. 1.
Figure 7:
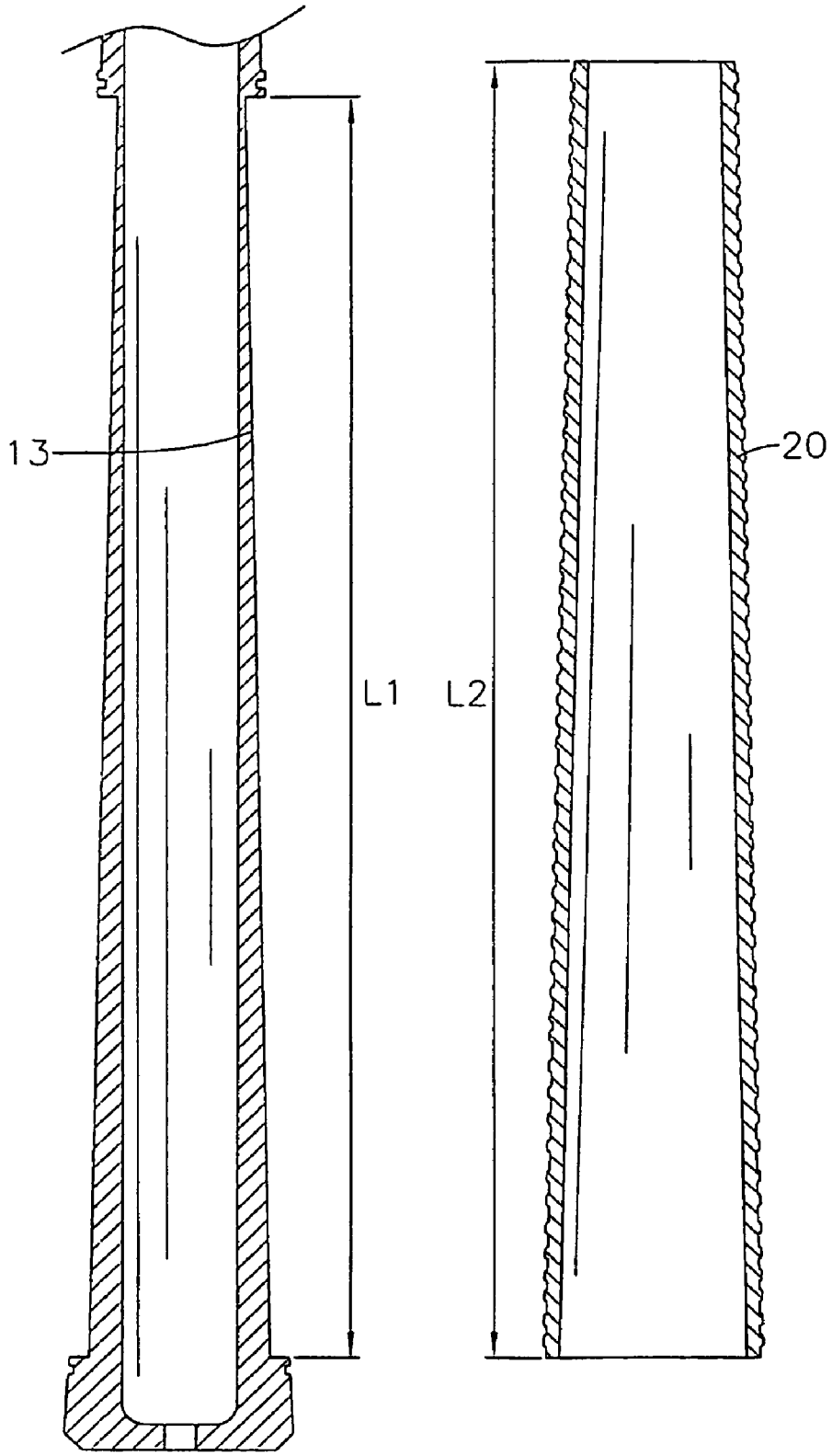
FIG. 7 is an enlarged partially exploded side view in cross section of the golf club in FIG. 1.

With further reference to FIGS. 3 and 7, the outer sleeve (20) is tubular, is mounted in the elongated annular recess (13) and has an elasticity, a hardness, two open-ends, an internal wall and a rough external wall. The elasticity of the outer sleeve (20) may be greater than the elasticity of the inner sleeve (10). The hardness of the inner sleeve (10) may be greater than the hardness of the outer sleeve (20). The length (L2) of the outer sleeve (20) is longer than the length (L1) of the elongated annular recess (13). Therefore the outer sleeve (20) is longer than the elongated annular recess (13). The open-ends of the outer sleeve (20) may be glued respectively on the ends of the elongated annular recess (13). The internal wall of the outer sleeve (20) is not bonded to the elongated annular recess (13) and only abuts the bottom surface of the elongated annular recess (13). The rough external wall may have multiple protrusions (21).

Figure 4:
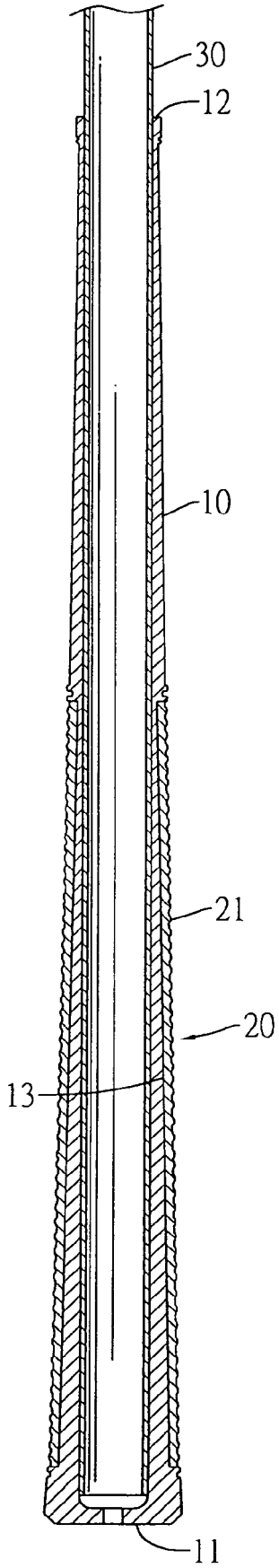
FIG. 4 is a cross sectional side view of the golf club grip in FIG. 1 mounted on a golf club shaft.
Figure 5:
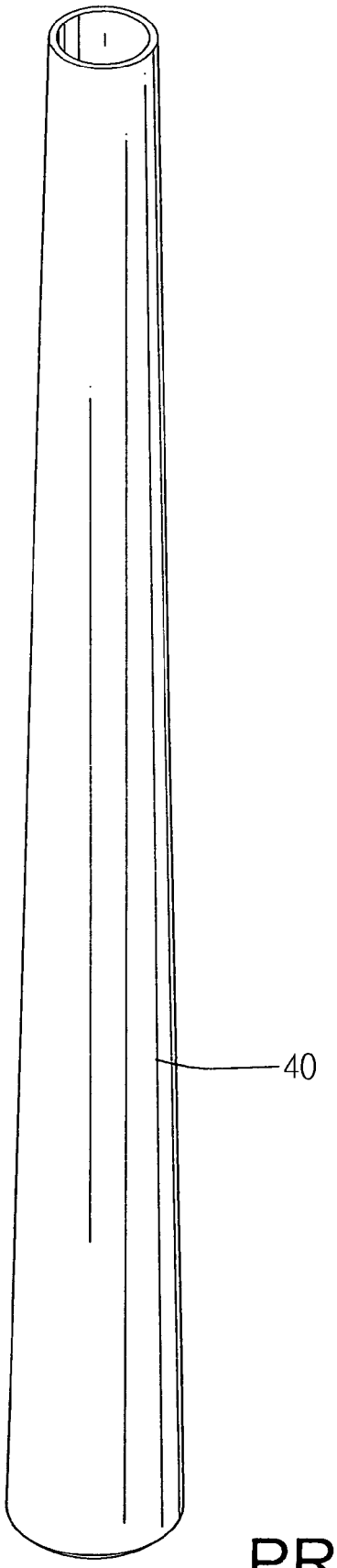
FIG.5 PRIOR ART
FIG. 5 is a perspective view of a conventional golf club grip in accordance with the prior art.
Figure 6:
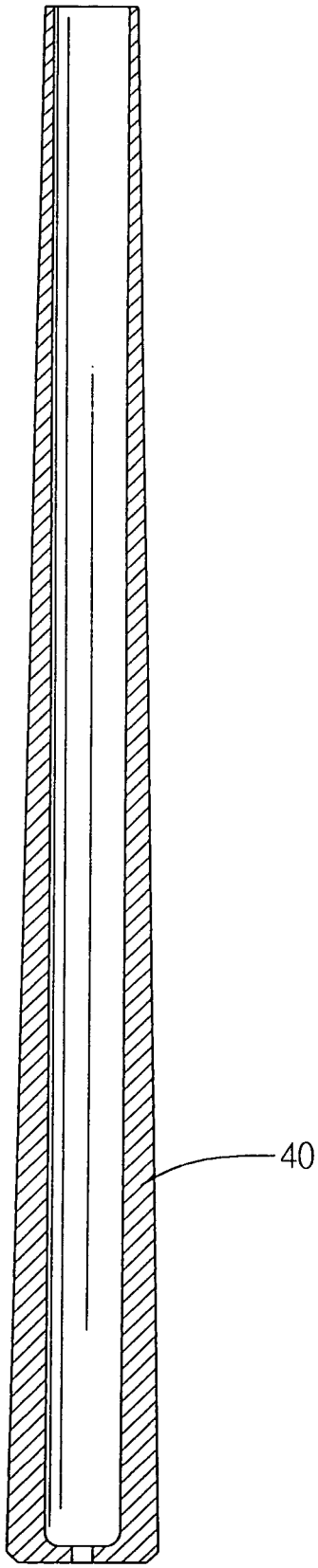
FIG.6 PRIOR ART
FIG. 6 is a cross sectional side view of the conventional golf club grip in FIG. 5.

With further reference to FIG. 4, the inner sleeve (10) is mounted on a golf club shaft (30). When the shaft (30) slides into the inner sleeve (10), the inner sleeve (10) is stretched, and the outer sleeve (20) is not stretched because the outer sleeve (20) is longer than the elongated annular recess (13) and the internal wall of the outer sleeve (20) is not bonded to the elongated annular recess (13). Therefore the elasticity of the outer sleeve (20) will not be reduced. The outer sleeve (20) can provide enough shock absorbability to prevent hands and arms of players from being injured when hitting a golf ball. Furthermore, the rough external wall (21) of the outer sleeve (20) prevents the golf club from slipping.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A golf club grip comprising an inner sleeve being tubular and having an elasticity;

a hardness;

an external wall;

a first end;

a second end; and an elongated annular recess annular formed in the external wall of the inner sleeve near the first end and having two ends and a bottom surface; and an outer sleeve being tubular, being longer than the elongated annular recess, mounted in the elongated annular recess and having an internal wall abutting the bottom surface of the elongated annular recess;

an elasticity;

a hardness;

two open-ends glued respectively only on the ends of the elongated annular recess;

an internal wall; and a rough external wall.

2. The golf club grip as claimed in claim 1, wherein the elasticity of the outer sleeve is greater than the elasticity of the inner sleeve; and the hardness of the inner sleeve is greater than the hardness of the outer sleeve.

3. The golf club grip as claimed in claim 1, wherein the rough external wall has multiple protrusions.

* * * * *